US007638949B2

(12) United States Patent
Hara et al.

(10) Patent No.: US 7,638,949 B2
(45) Date of Patent: Dec. 29, 2009

(54) ORGANIC ELECTROLUMINESCENCE DEVICE, METHOD FOR DRIVING THEREOF, AND ELECTRONIC APPLIANCE

(75) Inventors: Hiroyuki Hara, Chino (JP); Rie Makiura, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 671 days.

(21) Appl. No.: 11/353,038

(22) Filed: Feb. 14, 2006

(65) Prior Publication Data

US 2006/0192497 A1 Aug. 31, 2006

(30) Foreign Application Priority Data

Feb. 28, 2005 (JP) ..... 2005-053364

(51) Int. Cl.
*G09G 3/10* (2006.01)

(52) U.S. Cl. ..... 315/169.1; 315/169.3; 315/291; 345/76; 345/77; 313/463; 313/504; 313/506

(58) Field of Classification Search ... 315/169.1–169.4, 315/291, 307; 345/76, 77, 82–84, 92; 313/463, 313/498, 504, 506, 494; 257/40, 59, 72, 257/89, 99, 103; 428/690, 917
See application file for complete search history.

(56) References Cited

U.S. PATENT DOCUMENTS 5,748,160 A 5/1998 Shieh et al.
5,965,901 A * 10/1999 Heeks et al. ..... 257/40
6,175,345 B1 1/2001 Kuribayashi et al.
6,235,414 B1 * 5/2001 Epstein et al. ..... 428/690
6,366,025 B1 * 4/2002 Yamada ..... 315/169.3
6,373,455 B1 4/2002 Kuribayashi et al.
6,551,725 B2 * 4/2003 Raychaudhuri et al. ..... 428/690
6,689,632 B2 * 2/2004 Kim et al. ..... 438/29
6,784,621 B2 * 8/2004 Komoda et al. ..... 315/169.1
6,821,650 B2 * 11/2004 Miyata et al. ..... 428/690
6,876,007 B2 4/2005 Yamazaki et al.
6,933,574 B2 * 8/2005 Park et al. ..... 257/359
6,980,180 B2 12/2005 Hasagawa
6,998,789 B2 2/2006 Uchida
7,023,458 B2 4/2006 Kudo et al.
7,193,637 B2 3/2007 Kudo et al.
7,252,570 B2 8/2007 Takashima et al.
7,282,734 B2 10/2007 Yamazaki et al.
7,511,693 B2 3/2009 Kudo et al.
2003/0142509 A1 7/2003 Tsuchiya et al.
2005/0030264 A1 2/2005 Tsuge et al.
2005/0041002 A1 2/2005 Takahara et al.

(Continued)

FOREIGN PATENT DOCUMENTS

JP A-09-138659 5/1997

(Continued)

*Primary Examiner*—Haissa Philogene
(74) *Attorney, Agent, or Firm*—Oliff & Berridge, PLC

(57) ABSTRACT

An organic electroluminescence device includes: an emissive layer between an anode and a cathode facing each other; an anode buffer layer formed of a conductive material, installed between the anode and the emissive layer; a cathode buffer layer formed of the conductive material, installed between the cathode and the emissive layer; and a driving device which alternately applies a forward-biased voltage and a reverse-biased voltage which have different voltage values and polarities, to the anode and the cathode.

15 Claims, 10 Drawing Sheets

U.S. PATENT DOCUMENTS

| | | | |
|---|---|---|---|
| 2005/0057580 | A1 | 3/2005 | Yamano et al. |
| 2007/0146251 | A1 | 6/2007 | Tsuge et al. |
| 2008/0116788 | A1 | 5/2008 | Yamazaki et al. |

FOREIGN PATENT DOCUMENTS

| | | | |
|---|---|---|---|
| JP | A 09-293588 | | 11/1997 |
| JP | A-11-003048 | | 1/1999 |
| JP | A-2002-215094 | | 7/2002 |
| JP | A-2002-366112 | | 12/2002 |
| JP | A-2003-122305 | | 4/2003 |
| JP | A-2003-150082 | | 5/2003 |
| JP | A-2003-157983 | | 5/2003 |
| JP | A-2003-195816 | | 7/2003 |
| JP | A-2003-228331 | | 8/2003 |
| JP | A-2003-255899 | | 9/2003 |
| JP | A 2004-114506 | | 4/2004 |
| JP | A-2004-170487 | | 6/2004 |
| JP | A-2004-247279 | | 9/2004 |
| JP | A-2005-004062 | | 1/2005 |
| WO | WO 03/023750 | A1 | 3/2003 |
| WO | WO 03/027998 | A1 | 4/2003 |

* cited by examiner

ORGANIC ELECTROLUMINESCENCE DEVICE, METHOD FOR DRIVING THEREOF, AND ELECTRONIC APPLIANCE

BACKGROUND

1. Technical Field

The present invention relates to an organic electroluminescence device, a method for the driving thereof, and an electronic appliance.

2. Related Art

In recent years, organic electroluminescence (hereafter "organic EL") devices that include organic EL elements have been featured as a light-emitting element that does not require a light source such as backlight. An organic EL element has an organic EL layer, or in other words, a light-emitting element between a pair of counter electrodes that face each other. Organic EL devices for a full-color display have light-emitting elements that have a range of light-emitting wavelengths, each corresponding to red (R), green (G), and blue (B). When a voltage is applied between a pair of counter electrodes, implanted electrons and implanted holes recombine within a light-emitting element, thereby emitting light. The light-emitting element formed in these organic EL devices is normally formed in a thin film less than 1 μm thick. The backlights used in common liquid crystal display devices are not required in the organic EL devices, since the light-emitting element itself emits light. Therefore, it is an advantage for the organic EL devices, that the thickness thereof may be significantly thinner.

The luminescence property of the aforementioned light-emitting element is affected by: an external environment, molecules constituting an emissive layer, and a minute amount of impurities present in the emissive layer. For instance, impurity ions are diffused within the emissive layer, and are accumulated in a specific location, if the light-emitting element is driven by a direct current, where unidirectional bias is applied. This involves a problem that the accumulated impurity ions trap the holes or the electrons implanted from the electrode, thereby decreasing the luminescent life and the brightness of the light-emitting element. Moreover, the electric field, generated by a forward bias applied during the light emission, may cause orientation polarization or ionic polarization of ionic impurities. The direction of the internal electric field in the emissive layer, in which the orientation polarization and the ionic polarization have occurred, is opposite to the direction of the electric field generated by the forward-biased voltage required for light emission. Hence, the voltage applied during the light emission does not work effectively. This mechanism causes the luminescence property of the light-emitting element to deteriorate.

An example of impurities include ions of indium that constitutes indium tin oxide (hereafter "ITO"). In some heterostructure light-emitting elements, a functional layer adjacent to the emissive layer, and the emissive layer, are doped with impurities by their inner diffusion. Moreover, the impurity ions from the electrode may be doped into the emissive layer, if the electrode (cathode) composed with lithium fluoride (LiF) or calcium (Ca) is adjacent to it. If there is an insufficient refinement of organic compounds used for the emissive layer or the functional layer, the material used upon synthesis may reside as impurities. Moreover, there is a problem that the accumulated charges within the light-emitting element decrease the luminescent life and the brightness of the light-emitting element, when performing a direct current drive where the unidirectional bias is applied.

Considering the above problems, as disclosed in JP-A-9-293588 and JP-A-2004-114506 for instance, there are reports in which an alternating-current drive is used. Here, the driving voltages are forward-biased and reverse-biased, where the reverse-biased voltage has a reverse polarity of the forward-biased voltage, both of which are alternately applied to the light-emitting element during the light emission. Since voltages with different polarities are alternately applied to the emissive layer, this alternating-current drive moderates the accumulation of charges and impurity ions inside the light-emitting element, and the internal electric field generated by the impurity ions. Therefore, the decrease in luminescent life and brightness is suppressed.

However, the light-emitting element in the aforementioned alternating current drive normally has a multilayer structure including an anode, an emissive layer, and a cathode. Hence, the light is emitted only when the forward-biased voltage is applied, i.e. when a positive voltage is applied from the anode and a negative voltage is applied from the cathode. That is to say, the light-emitting element does not emit light when the reverse-biased voltage is applied using the alternating current. As described, this has been a cause of another problem that the shorter the effective light emission time is, the darker the display becomes.

SUMMARY

The advantage of the present invention is to provide an organic EL device that allows a suppression of flickering without shortening the effective light emission time during a display, when the alternating-current drive is performed. In this alternating-current drive, the forward bias and the reverse bias are alternately applied to the emissive layer. It is also the advantage of the invention to provide a driving method of this organic EL device described above, and an electronic appliance including this organic EL device.

According to an aspect of the invention, an organic EL device includes: an emissive layer between an anode and a cathode facing each other; an anode buffer layer formed of a conductive material, installed between the anode and the emissive layer; a cathode buffer layer formed of the conductive material, installed between the cathode and the emissive layer; and a driving device which alternately applies a forward-biased voltage and a reverse-biased voltage which have different voltage values and polarities, to the anode and the cathode.

According to the above aspect of the invention, there is a continuous light emission during the period when voltages with different polarities are alternately applied, since a structure that includes the emissive layer, and the anode buffer layer, and the cathode buffer layer both of which are composed with the conductive material, is formed between the opposing anode and cathode. Therefore, the accumulation of the charges and impurity ions inside the emissive layer, as well as the internal electric field generated by the impurity ions, are moderated, thereby allowing a display without shortening the effective light emission time. Since the forward-biased voltage and the reverse-biased voltage with different values and polarities are alternately applied, even if the luminescence property of the emissive layer during the application of either the forward-biased or reverse-biased voltage is not the same, the brightness is approximately the same for both biased voltages, thereby allowing the suppression of flickering.

It is preferable that, in this organic EL device, either one of the values of the forward-biased or the reverse-biased voltage be configured based on the other.

In this case, there is an effect that the brightness obtained during the application of a voltage with one polarity may be matched to the brightness obtained during the application of a voltage with the other polarity.

It is preferable that, in this organic EL device, the values of the forward-biased voltage and the reverse-biased voltage be configured so that a fluctuation of a brightness of the emissive layer does not exceed a prescribed value.

In this case, the prescribed value is configured not to exceed the brightness obtained by dividing the maximum brightness of the emissive layer by the number of gradations expressed by a light emission of the emissive layer.

Here, the brightness fluctuation of the emissive layer is set below the prescribed value, specifically, below the brightness obtained in the manner described above. Therefore, there is an effect that even if a slight difference of brightness exists between the forward-biased voltage application and the reverse-biased voltage application, this difference is seldom visually recognized as a flicker. Moreover, the configuration becomes easier, since there is a certain amount of permissible range when configuring the forward and backward biased voltages.

It is preferable that, in the organic EL device, the emissive layer include: a red emissive layer that emits red light, a green emissive layer that emits green light, and a blue emissive layer that emits blue light. It is also preferable that the aforementioned driving device change the values of the forward-biased voltage and the reverse-biased voltage applied, for the red emissive layer, for the green emissive layer, and for the blue emissive layer.

In this case, since the values of the forward-biased and the reverse-biased voltages applied per emissive layer of red, green, and blue are set differently, the brightness of each layer may be configured equally, even though there are differences in the luminescence property between the red, green, and blue emissive layers.

It is preferable that, in this organic EL device, the driving device alternately apply the forward-biased voltage and the reverse-biased voltage, by a frame unit or a sub frame unit of a display image displayed in the organic EL device, the sub frame being provided by a time division of one frame divided into several parts.

In this case, the toggling of the display image and the toggling between the forward and reverse biased voltages are performed in the same timing. Hence, the display quality degradation and an increase in the complexity the driving device are prevented.

It is preferable that, in this organic EL device, the anode buffer layer and the cathode buffer layer be formed of a conductive polymer.

It is also preferable that the anode buffer layer and the cathode buffer layer be formed of a high polymer that includes ethylenedioxythiophene.

The anode buffer layer and the cathode buffer layer may also be formed of polyethylene(3,4-dioxythiophene)/polystyrene sulfonate.

Here, it is preferable that sheet resistivity of the anode buffer layer and the cathode buffer layer be less than 100Ω cm.

According to another aspect of the invention, a method for driving an organic EL device includes applying alternately a forward-biased voltage and a reverse-biased voltage which have different voltage values and polarities to an anode and a cathode, wherein: at least one emissive layer is provided between the anode and the cathode which face each other; an anode buffer layer formed of a conductive material is installed between the anode and the emissive layer; and a cathode buffer layer formed of the conductive material is installed between the cathode and the emissive layer.

The structure that includes the emissive layer, and the anode buffer layer and the cathode buffer layer both of which are formed of the conductive material, is deposited between the opposing anode and cathode, and the forward-biased and the reverse-biased voltages with different values and polarities are alternately applied to this structure. Therefore, there is a continuous light emission during the application of both forward-biased and reverse-biased voltages, and the brightness is approximately the same for both biased voltages, even if the luminescence property of the emissive layer during the application of either the forward-biased or the reverse-biased voltage is not the same. Consequently, the flickering may be suppressed.

It is preferable that, in this method of driving the organic EL device, either one of the values of the forward-biased or the reverse-biased voltages be configured based on the other.

In this case, there is an effect that the brightness obtained during the application of a voltage with one polarity may be matched to the brightness obtained during the application of a voltage with the other polarity.

It is preferable that, in this method of driving the organic EL device, the values of the forward-biased voltage and the reverse-biased voltage be configured so that a fluctuation of a brightness of the emissive layer does not exceed a prescribed value.

In this case, the prescribed value is configured not to exceed the brightness obtained by dividing the maximum brightness of the emissive layer by the number of gradations expressed by a light emission of the emissive layer.

Here, the brightness fluctuation of the emissive layer is set below the prescribed value, specifically, below the brightness obtained in the manner described above. Therefore, there is an effect that even if a slight difference of brightness exists between the forward-biased voltage application and the reverse-biased voltage application, this difference is seldom visually recognized as a flicker. Moreover, the configuration becomes easier, since there is a certain amount of permissible range when configuring the forward and backward biased voltages.

It is preferable that, in this method of driving the organic EL device, the emissive layer include: a red emissive layer that emits red light, a green emissive layer that emits green light, and a blue emissive layer that emits blue light. It is also preferable that the forward-biased and the reverse-biased voltages with different voltage values and polarities be alternately applied, for the red emissive layer, for the green emissive layer, and for the blue emissive layer.

In this case, since the values of the forward-biased and the reverse-biased voltages applied per emissive layer of red, green, and blue are set differently, the brightness of each layer may be configured equally, even though there are differences in the luminescence property between the red, green, and blue emissive layers.

It is preferable that, in this method of driving the organic EL device, the driving device alternately apply the forward-biased and the reverse-biased voltages, by a frame unit or a sub frame unit of a display image displayed in the organic EL device, the sub frame being provided by a time division of one frame divided into several parts.

In this case, the toggling of the display image and the toggling between the forward and reverse biased voltages are performed in the same timing, thereby preventing the display quality degradation.

According to a further aspect of the invention, an electronic appliance is provided with the organic EL device described above.

With this structure, the electronic appliance with a favorable display characteristic may be provided.

BRIEF DESCRIPTION OF THE DRAWINGS

The invention will be described with reference to the accompanying drawings, wherein like numbers reference like elements.

FIG. 5 is a magnified drawing of a circuit unit 11 including driving TFTs 123 and the like.

DESCRIPTION OF EXEMPLARY EMBODIMENTS

An organic EL device, the driving method thereof, and an electronic appliance, according to an embodiment of the present invention, will now be described with reference to the drawings. The embodiment described hereafter merely represents one of the embodiments for the present invention, and shall not limit the invention. The invention allows any modification within the main technical scope of the invention. Figures shown hereafter have different scale sizes for each of the layers and components, so that each of them will be big enough to be recognized in the figures.

Organic EL Device

Figure 1:
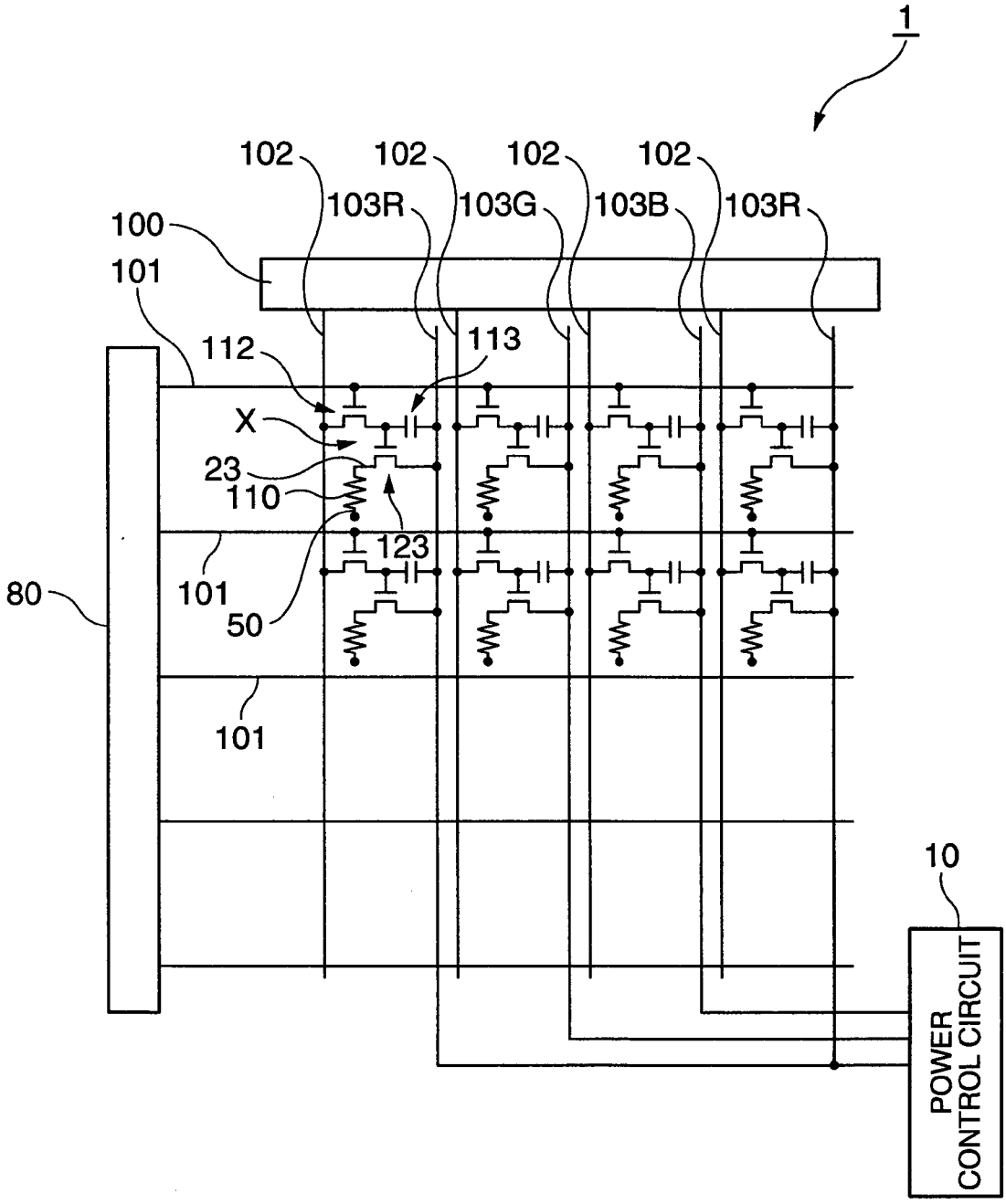
FIG. 1 is a schematic drawing showing a wiring structure of an organic EL device 1 in accordance with one embodiment of the invention.

FIG. 1 is a schematic drawing showing a wiring structure of an organic EL device according to the embodiment of the invention. An organic EL device 1 shown in FIG. 1 employs an active matrix system, using a thin film transistor (hereafter "TFT") as a switching element, and includes a plurality of scanning lines 101, a plurality of signal lines 102 extending in the direction orthogonal to the scanning lines 101, and a wiring configuration provided with a plurality of power source lines 103R, 103G, and 103B, extending in parallel to the signal lines 102; thereby forming pixel regions X at cross points of scanning lines 101 and signal lines 102. The power source lines 103R, 103G, and 103B may also be collectively called power lines 103 in the description below.

The pixel regions X arrayed along the power source lines 103R emit a red light while the pixel regions X arrayed along the power source lines 103G emit a green light and the ones arrayed along the power source lines 103B emit a blue light. As described, in the organic EL device 1 according to the embodiment, luminescent regions of the same color are arrayed along the signal lines 102 and the power source lines 103, having a vertical stripe structure, in which read, green, and blue light emission regions are sequentially repeated along the direction of the scanning lines 101. Each of the power source lines 103R, 103G, and 103B is connected to the power control circuit 10. A data line driving circuit 100 that includes a shift register, a level shifter, a video line, and an analog switch, is connected to the signal lines 102. Moreover, a scanning line driving circuit 80 that includes the shift register and the level shifter is connected to the scanning lines 101.

In each of the pixel regions X, the following items are installed: a switching TFT 112, in which a scanning signal is supplied to its gate electrode through each scanning line 101; a holding capacitor 113 that hold a pixel signal shared from each signal line 102 through the switching TFT 112; a driving TFT 123, in which the pixel signal held by the holding capacitor 113 is supplied to the gate electrode; a pixel electrode (or simply "electrode") 23, into which the drive current flows from the power source line 103 when the driving TFT 123 is electrically connected to the power source line 103; and a functional layer 110 sandwiched between the pixel electrode 23 and a common cathode (or simply "electrode") 50. Each pixel electrode 23, each functional layer 110, and the common cathode 50 constitute one light-emitting element, in other words, an organic EL element.

In the organic EL device 1 with above structure, if the switching TFTs 112 are switched on by driving the scanning lines 101, the potential of the signal lines 102 of that time is held in those holding capacitors 113, and according to the status of the holding capacitors 113, the on-off status of the driving TFTs 123 is determined. Thereafter, the current flows from the power source lines 103 to the pixel electrodes 23 through the channels of the driving TFTs 123, as well as to the common cathode 50 through the functional layers 110. Consequently, the functional layers 110 emit light corresponding to the amount of current flowing therein.

Figure 2:
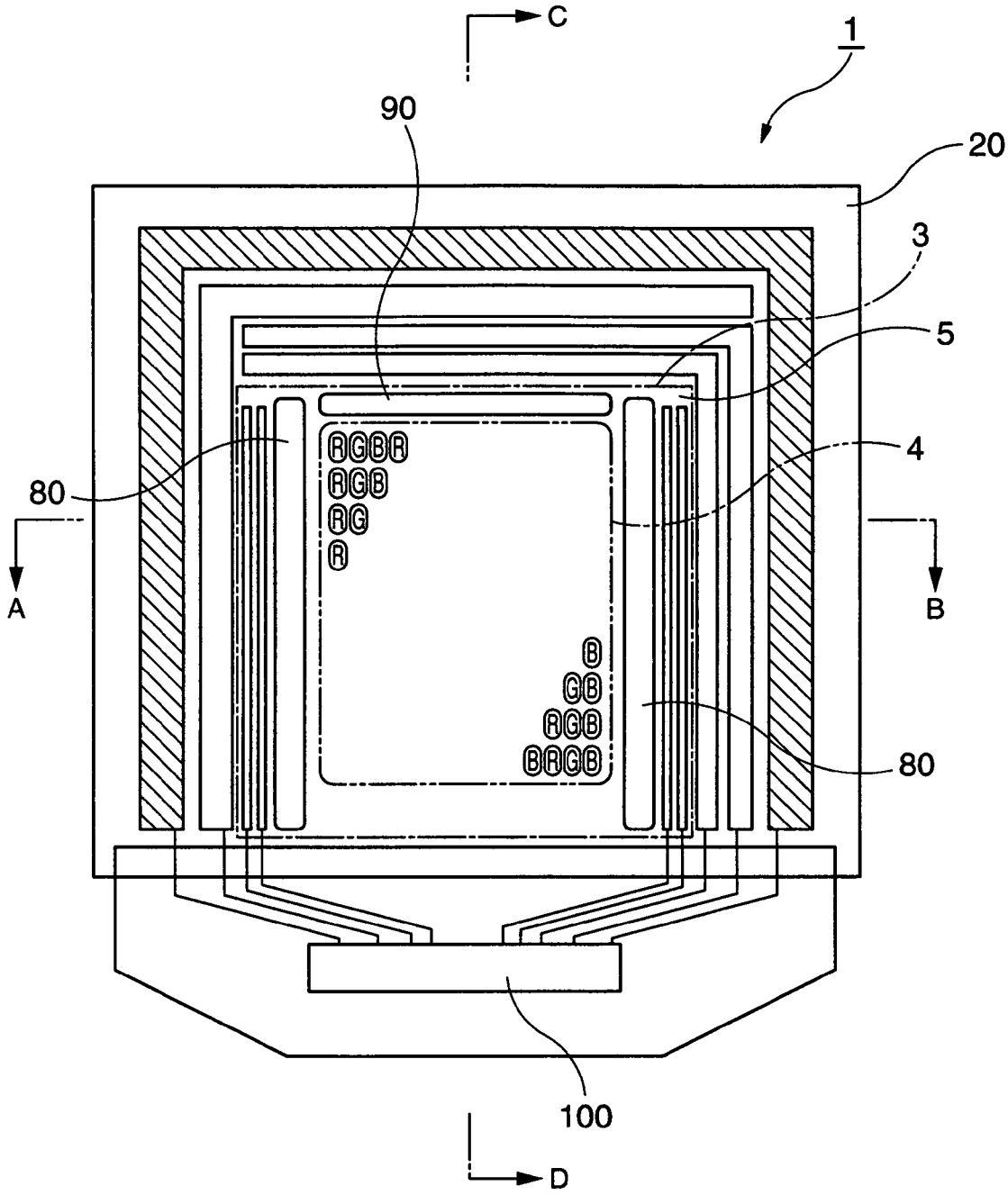
FIG. 2 is a top view drawing schematically showing a structure of the organic EL device 1 in accordance with one embodiment of the invention.

FIG. 2 is a top view drawing schematically showing a structure of the organic EL device 1 in accordance with one embodiment of the invention. As shown in FIG. 2, the organic EL device 1 includes: a substrate 20 with optical transparency and electrical insulation property; pixel electrode regions (not shown) where the pixel electrodes connected to the switching TFTs (not shown in FIG. 2) are arranged in matrix on the substrate 20; the power source lines 103 (i.e. 103R, 103G, and 103B) arranged around the pixel electrode regions and connected to each pixel electrode; and an approximately rectangular (when viewed from top) pixel area 3 (inside the area indicated by dashed lines in FIG. 2), covering at least the pixel electrode regions. The pixel area 3 is divided into sections of an effective display region 4 (inside the area indicated by double dashed lines in FIG. 2), and of a dummy region 5 arranged around the effective display region 4 (excluding the area indicated by the double dashed lines from the area shown in the dashed lines).

Display areas R, G, and B, each having an pixel electrode, are arranged in order, within the effective display region 4 in the directions of A to B and C to D in FIG. 2. One scanning line driving circuit 80 is arranged on each side of the effective display region 4 in FIG. 2. Each scanning line driving circuit 80 is installed on the, side of the lower layer of the dummy region 5. A testing circuit 90 is arranged on the upper side of the effective display region 4 in FIG. 2, installed at the side of the lower layer of the dummy region 5. The testing circuit 90 tests the activity of the organic EL device 1, and includes, for instance, a test information output unit (not shown) that outputs the testing result to the outside, so as to allow testing of quality and defects of display device during the manufacturing or upon shipping.

The driving voltages of the scanning line driving circuit 80 and the testing circuit 90 are applied via driving voltage continuity parts 310 (refer to FIG. 3) and driving voltage continuity parts 340 (refer to FIG. 4), from a prescribed power source. Driving control signals and the driving voltages transmitted to the scanning line driving circuit 80 and the testing circuit 90 are transmitted and applied via driving control signal continuity parts 320 (refer to FIG. 3) and driving voltage continuity parts 340 (refer to FIG. 4), from a prescribed main driver or the like that is responsible for the activity control of the organic EL device 1. Here, the driving control signals are command signals from the main driver or the like that is associated to a control of the time when the scanning line driving circuit 80 and the testing circuit 90 output signals.

Figure 3:
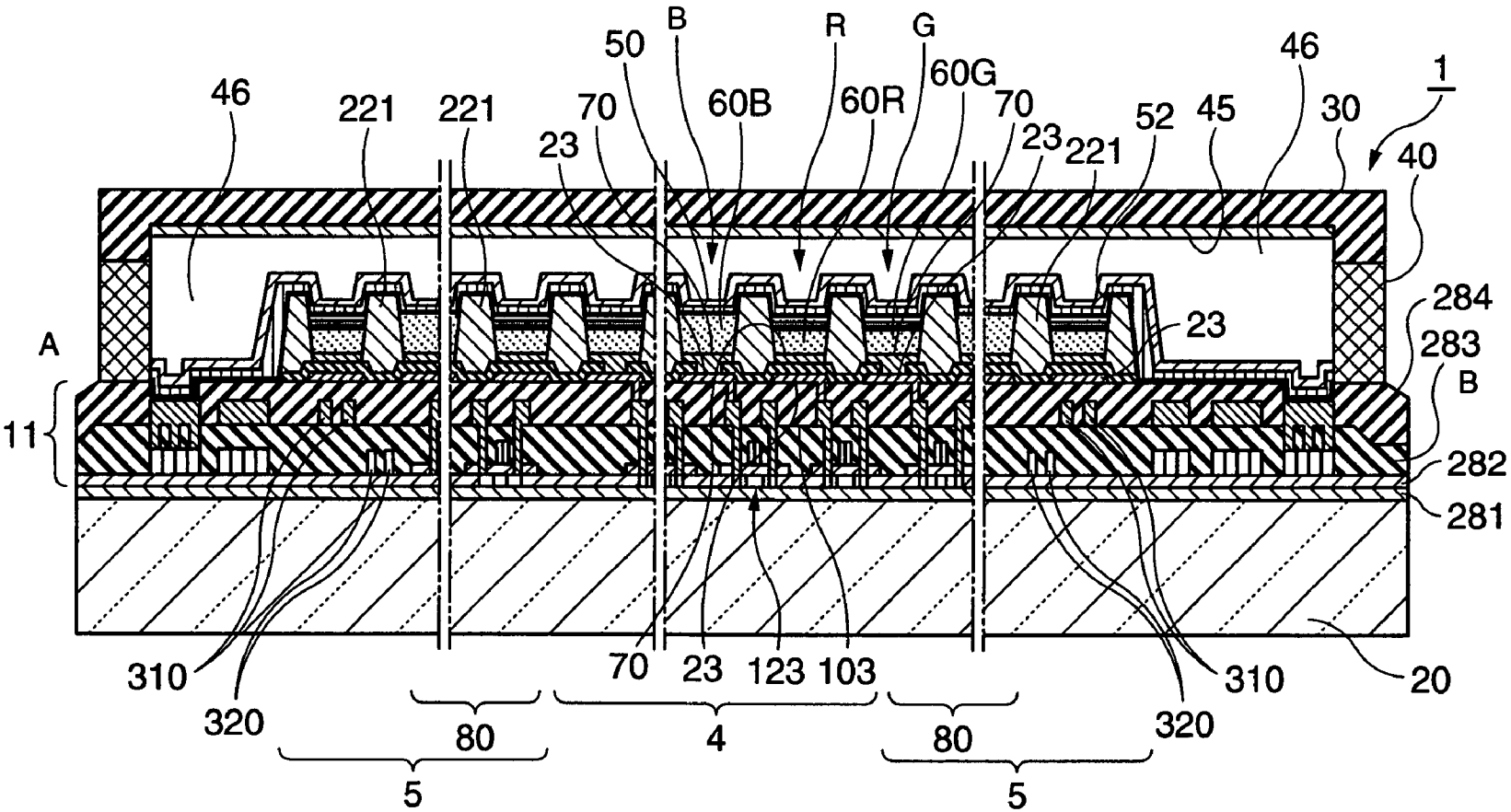
FIG. 3 is a sectional drawing along a section A to B in FIG. 2.
Figure 4:
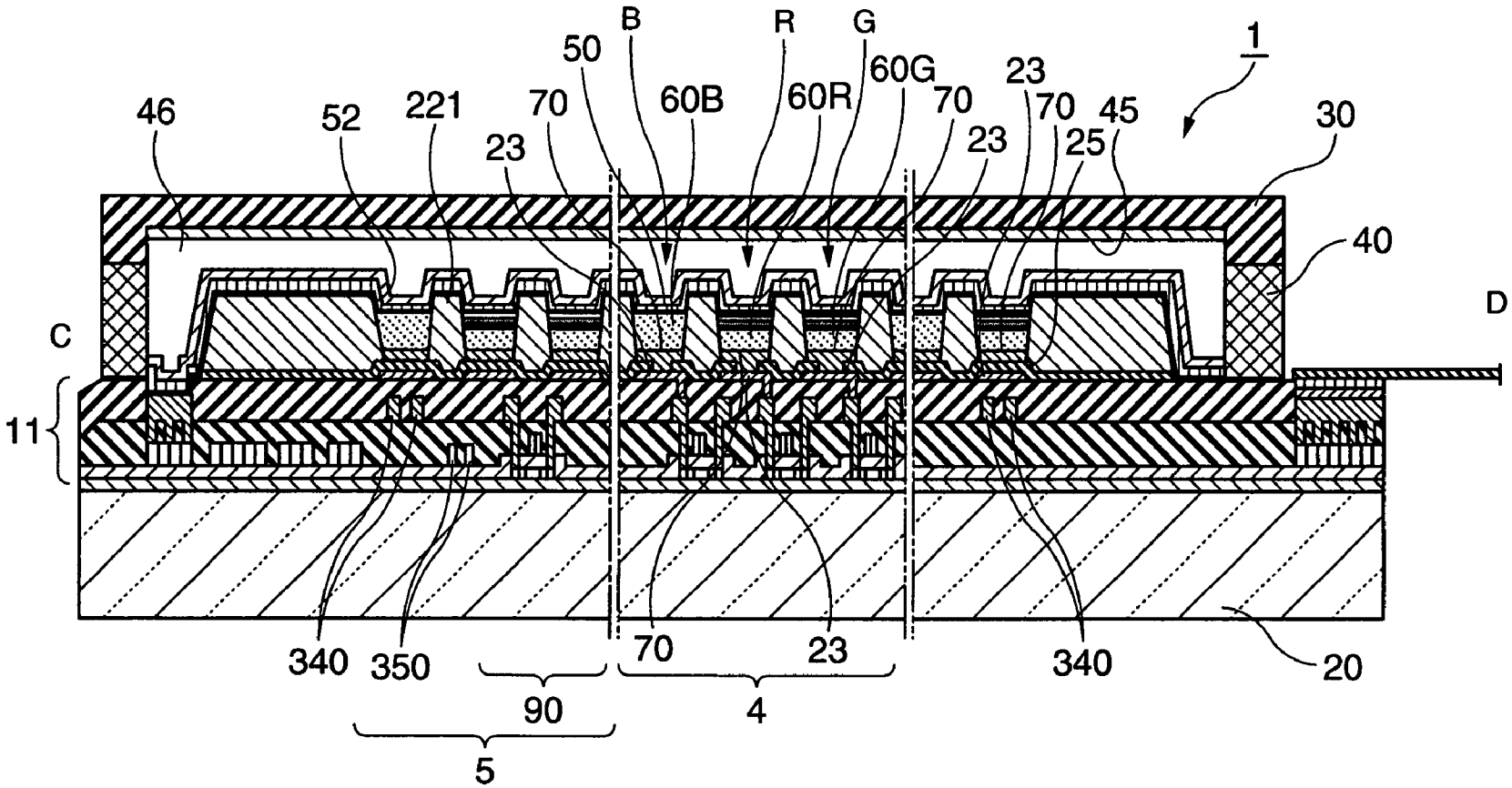
FIG. 4 is a sectional drawing along a section C to D in FIG. 2.

FIG. 3 is a sectional drawing along a section A to B in FIG. 2, and FIG. 4 is a sectional drawing along a section C to D in FIG. 2. As shown in FIGS. 3 and 4, the substrate 20 and a sealing substrate 30, that are adhered together via resin 49 constitute the organic EL device 1. A getter material 45 that absorbs moisture and oxygen is adhered in the internal surface of the sealing substrate 30, in the region surrounded by the substrate 20, the sealing substrate 30, and the sealing resin 40. Moreover, the internal space of the aforementioned surrounded region is filled in with a nitrogen gas, constituting a nitrogen gas filled layer 46. With such structure, the penetration of the moisture and oxygen into the organic EL device 1 is suppressed; hence the organic EL device 1 is designed to have a long lifetime.

Any one of transparent and non-transparent substrates may be used for the substrate 20 in the case of a top emission organic EL device, since an emitting light is extracted from the side of the sealing substrate 30 that is on the opposite side of the substrate 20. Examples of the non-transparent substrate includes: ceramics such as alumina; a metal sheet on which an insulation process such as surface oxidation is conducted, for instance, with stainless steal and the like; thermosetting resin; thermoplastic resin; and the like.

Either a transparent and translucent substrate is employed for the substrate 20 in a so-called bottom emission organic EL device, since an emitted light is extracted from the substrate 20 side. Examples of materials for the substrate 20 includes glass, quartz, resin such as plastics and plastic films, and the like. Particularly a glass substrate is suitable. In this embodiment, the bottom emission model, where the light is extracted from the side of the substrate 20, is employed, and thus either the transparent or translucent substrate is used for the substrate 20. A placoid material with electrical insulation, for instance, may be employed for the sealing substrate 30. Moreover, the sealing resin 40 is made of, for instance, thermosetting resin or ultraviolet curing resin. Particularly, epoxy resin, a kind of thermosetting resin is suitable.

Figure 5:
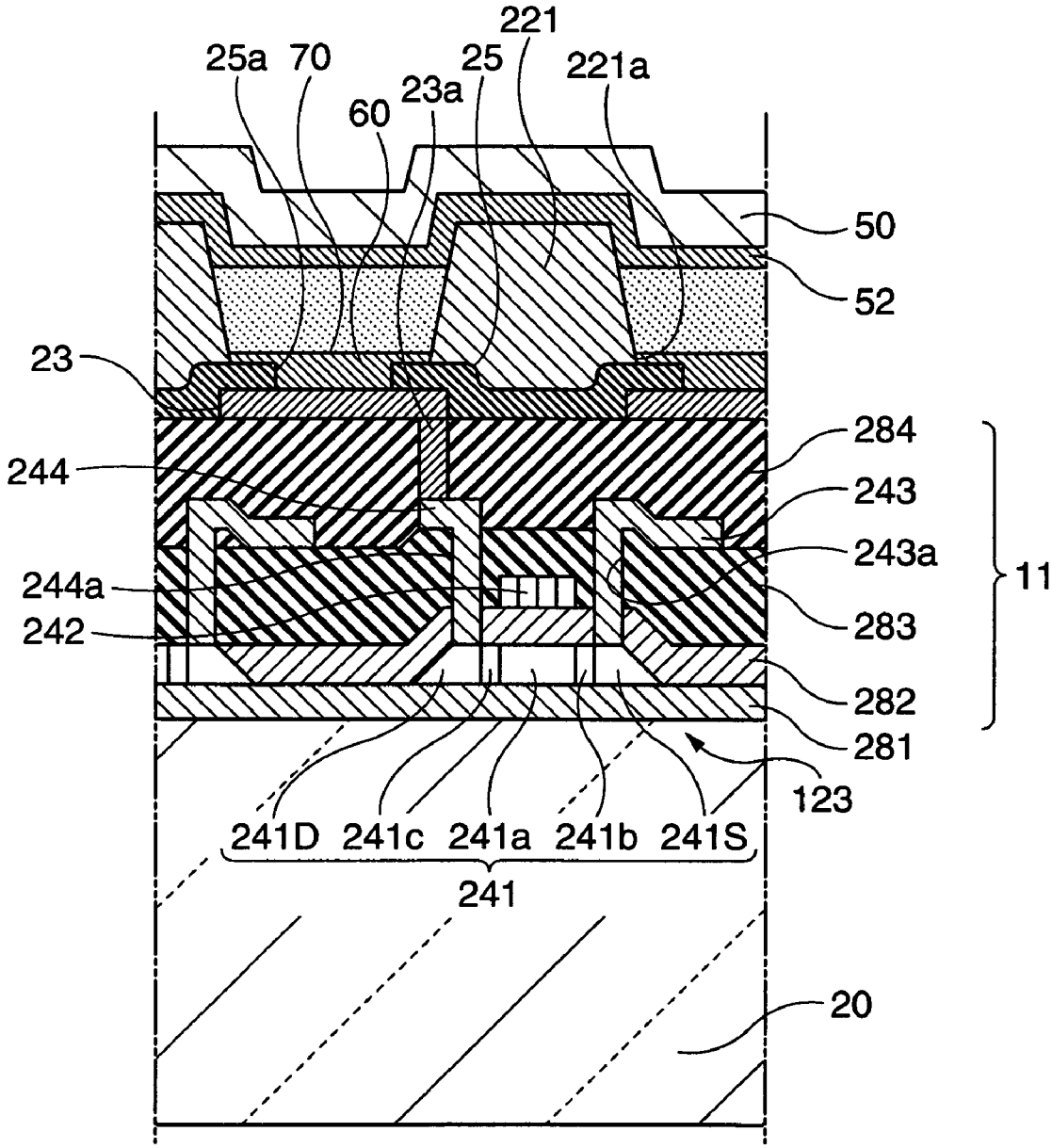

A circuit unit 11 including the driving TFTs 123 and the like for driving the pixel electrodes 23 is formed on the substrate 20. FIG. 5 is a magnified drawing of the circuit unit 11 including the driving TFTs 123 and the like. A under protection layer 281 mainly containing $SiO_2$ is formed as a under layer on the surface of the substrate 20, and a silicon layer 241 is formed thereon. A gate insulation layer 282 mainly containing $SiO_2$ and/or SiN is formed on the surface of this silicon layer 241.

The area where the silicon layer 241 overlaps with a gate electrode 242 across the gate insulation layer 282 is called a channel region 241*a*. The gate electrode 242 is a part of one scanning lines 101 (not shown in FIG. 5). A first interlayer insulation layer 283, mainly containing $SiO_2$ is formed on the surface of the gate insulation layer 282, covering the silicon layer 241.

A low-density source region 241*b* and a high-density source region 241S are installed on the source side of the channel region 241*a* in the silicon layer 241. A low-density drain region 241*c* and a high-density drain region 241D are installed on the drain side of the channel region 241*a*. Together, they constitute a so-called light doped drain (LDD) structure. The high-density source region 241S is connected to a source electrode 243 through a contact hole 243*a* that opens through the gate insulation layer 282 and the first interlayer insulation layer 283. The source electrode 243 is configured as a part of the aforementioned power source lines 103 (refer to FIGS. 1 and 5; in FIG. 5, the lines are extended in the vertical direction at the location of the source electrode 243). The high-density drain region 241D is connected to a drain electrode 244, made in a same layer as the source electrode 243, through a contact hole 244*a* that opens through the gate insulation layer 282 and the first interlayer insulation layer 283.

The upper layer of the first interlayer insulation layer 283, in which the source electrode 243 and the drain electrode 244 are formed, is covered with a second interlayer insulation layer 284 that, mainly contains, for instance, the resin component of acrylic system. This second interlayer insulation layer 284 may also use materials other than acrylic system for insulation film, such as SiN or $SiO_2$. Each of the pixel electrodes 23 composed of ITO is formed on the surface of the second interlayer insulation layer 284, and is connected to the drain electrode 244 via a contact hole 23*a* installed in the second interlayer insulation layer 284. In other words, each of the pixel electrodes 23 is connected to the high-density drain region 241D of the silicon layer 241, via the drain electrode 244.

The components formed on the substrate 20 as described above, i.e. the components from under protection layer 281 to the second interlayer insulation layer 284 constitute the circuit unit 11. TFTs (driving circuit TFTs) driving circuits such as the scanning line driving circuit 80 and the testing circuit 90, or in other words, N-channel type TFTs or P-channel type TFTs that constitute inverters that are included, for instance, in the shift register, have the same structure as that of the driving TFTs 123, except that they are not connected to the pixel electrodes 23.

The surface of the second interlayer insulation layer 284 on which the pixel electrodes 23 are formed is covered by: the pixel electrodes 23, a lyophilic control layer 25 mainly containing lyophilic materials such as $SiO_2$, and an organic bank layer 221 made of acrylic resin, polyimide resin or the like. "Lyophilic" in the lyophilic control layer 25 in the embodiment means that lyophilic property is higher than that of the materials such as acrylic resin or polyimide resin, to say the least, which constitute the organic bank layer 221. The pixel regions are inside the openings 25*a* provided in the lyophilic control layer 25 as well as inside the openings 221*a* provided in the organic bank layer 221. In the boundaries of the pixel regions (color display regions), black matrixes (hereafter "BM"; not shown), deposited by, for instance, sputtering using chromium metal, are formed between the organic bank layer 221 and the lyophilic control layer 25.

The light-emitting elements (organic EL elements) R, G, and B are provided above the pixel electrodes 23 of the pixel regions. The light-emitting elements R, G, and B are structured by sequentially forming: the pixel electrodes 23 that function as anodes; an anode buffer layer 70; emissive layers 60 (60R, 60G, and 60B) made of an organic EL material; a cathode buffer layer 52; and the common cathode 50. Upon applying the forward-biased voltage, the light-emitting elements R, G, and B respectively emit red, green, and blue lights, by recombination of holes implanted from the anode buffer layer 70 and electrons implanted from the cathode buffer layer 52, within the emissive layers 60. Upon applying the reverse-biased voltage, the light-emitting elements emit red, green, and blue lights, by the recombination of the electrons implanted from the anode buffer layer 70 and holes implanted from the cathode buffer layer 52, within the emissive layers 60.

The pixel electrodes 23 that function as anodes is formed with a transparent conductive material, since in this embodiment, the bottom emission model is employed. ITO is suitable for the transparent conductive material. Another example of the material is an amorphous transparent conductive film of indium oxide and zinc oxide system, such as Indium Zinc Oxide (IZO, a registered trademark of Idemitsu Kosan Co., Ltd). In this embodiment, ITO is used. In the top emission model, a material with optical transparency is not required, and a reflection layer with aluminum (Al) and the like, provided in the lower layer of ITO, may also be used.

A particularly suitable material for the anode buffer layer 70 is Poly(3,4-ethylenedioxythiophene) poly(styrenesulfonate) aqueous dispersion, i.e. the material in which 3,4-polyethylene-dioxythiophene is dispersed into a dispersion medium of polystyrenesulfonate. Thereafter they are dissolved into a polar solvent, such as water or isopropyl alcohol. It is suitable that the sheet resistivity of the anode buffer layer 70 be less than 100Ω cm. In this embodiment, a sheet resistivity of under 0.1Ω cm is used suitably.

Known luminous materials that can emit fluorescence or phosphorescence are used for forming the emissive layers 60. In this embodiment, the wavelength bandwidth of the lights emitted by the luminous materials corresponds to the three primary colors of the light, for a full-color display. In other words, one pixel is configured with three emissive layers, i.e., one emissive layer 60R, one emissive layer 60G, and one emissive layer 60B, the wavelength bandwidth of the emitting-lights thereof respectively corresponding to red, green, and blue. The organic EL device 1 displays in full-color as a whole, when these layers emit light in gradation.

Examples of a suitable material for the emissive layers 60 include: derivatives of poly(fluorine) (PF), derivatives of poly (p-phenylenevinylene) (PPV), derivatives of polyphenylene (PP), poly(p-phenylene) (PPP), polyvinylcarbazol (PVK), derivatives of polythiophene, and a polysilane system such as polymethylphenylsilane (PMPS). Materials of polymer system or low-molecular materials may also be doped into these macromolecule materials listed above. The materials of polymers include pigment groups of perylenes, coumarines, and rhodamines, and the low-molecular materials include rubrene, perylene, 9,10-diphenylanthracene, tetraphenyl butadiene, nile red, coumarin 6, and quinacridone. Here, "macromolecule" means a polymer with a larger molecular weight than a "low-molecular" substance with a molecular weight of several hundreds. The aforementioned macromolecule materials include oligomers with a molecular weight of 10000 and/or less, besides what is generally referred to as high polymers with the molecular weight of 10000 and/or more.

In this embodiment, the materials used for red, green, and blue emissive layers 60R, 60G, and 60B are respectively: poly(3-methoxy6-(3-ethylhexyl)-p-phenylenevinylene), i.e. MEHPPV; a mixed solution of polydioctylfluorene and the alternating copolymer of dioctylfluorene-co-benzothiadiazole (F8BT); and polydioctylfluorene. There is no specific limitation on the thickness of these emissive layers 60, while each layer for each of the colors has a different suitable thickness. For instance, the suitable thickness of the blue emissive layer 60B is approximately in the range of 60 to 70 nm inclusive.

A particularly suitable material for the cathode buffer layer 52 is the same as that of the anode buffer layer 70, poly(3,4-ethylenedioxythiophene) poly(styrenesulfonate) aqueous dispersion, i.e. the material in which 3,4-polyethylene-dioxythiophene is dispersed into a dispersion medium of polystyrenesulfonate. Thereafter the material and the dispersion medium are dissolved into a polar solvent, such as water or isopropyl alcohol. It is suitable that the sheet resistivity of the cathode buffer layer 52 be less than 100Ω cm. In this embodiment, a sheet resistivity of under 0.1Ω cm is used suitably.

The common cathode 50 has, as shown in FIGS. 3 to 5, a wider area than the total area of the effective display region 4 and the dummy region 5, so as to be able to cover both of them. The examples of the material used for the common cathode 50 is not specifically limited as long as it is a chemically stable conductive material, and may include metals, alloys or the like. Particularly, aluminum (Al) is suitably used. The thickness of the common cathode 50 may suitably be set within the range of approximately 100 nm to 500 nm inclusive; particularly, approximately 200 nm is a preferable value. If the thickness is less than 100 nm, then there may not be sufficient protection, and if the thickness is more than 500 nm, then thermo-load during the manufacturing increases, and may cause a negative effect to the emissive layers 60, such as deterioration and alteration. In this embodiment, aurum (Au) forms the common cathode 50. Particularly in the case of employing the top emission model for the organic EL device, the common cathode 50, thin enough to have translucence, or, the common cathode using the translucent conductive material, such as ITO, may be formed.

In the organic EL device 1 structured as such with the anode buffer layer and the cathode buffer layer described above, there is a continuous light emission during the alternate application of voltages with different polarities. Therefore, the accumulation of the charges and of the impurity ions inside the light-emitting element, as well as the internal electric field generated by the impurity ions, are both moderated, thereby allowing a display without shortening the effective light emission time.

Figure 6:
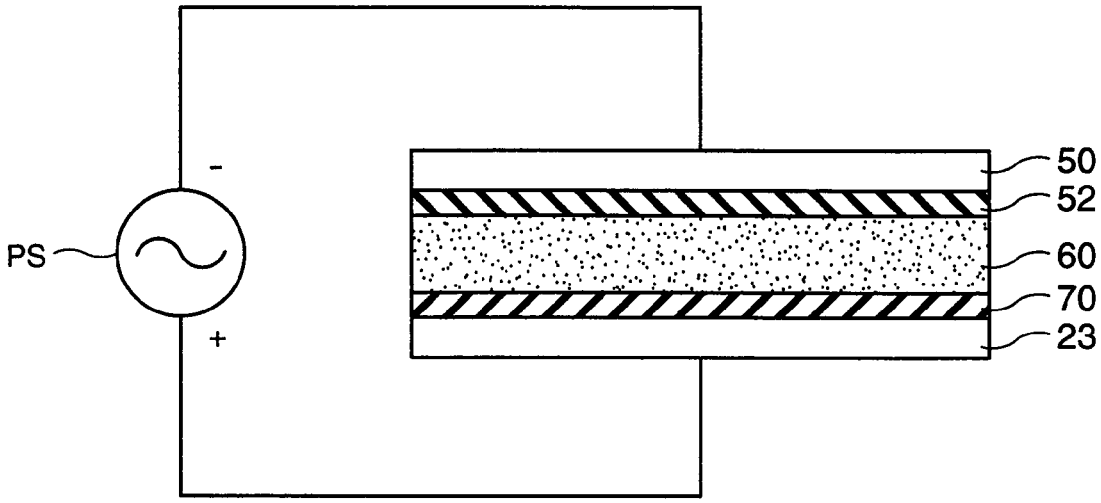
FIG. 6 is a drawing schematically showing a driving system of one light-emitting element.

FIG. 6 is a drawing schematically showing a driving system of one light-emitting element. As shown in FIG. 6, one light-emitting element includes one of the pixel electrodes 23, the anode buffer layer 70, one of the emissive layers 60, the cathode buffer layer 52, and the common cathode 50. The pixel electrode 23 is connected to the anode of an alternating current power source PS, and the common cathode 50 is connected to the cathode of the alternating current power source PS. The alternating current power source PS corresponds to the power control circuit 10 shown in FIG. 1. As described above, in the organic EL device 1 in this embodiment, there is a light emission during the application of both forward-biased and reverse-biased voltages, applied between the pixel electrode 23 and the common cathode 50. However, the luminescence property thereof differs among the application of the forward-biased and the reverse-biased voltages.

Figure 7:
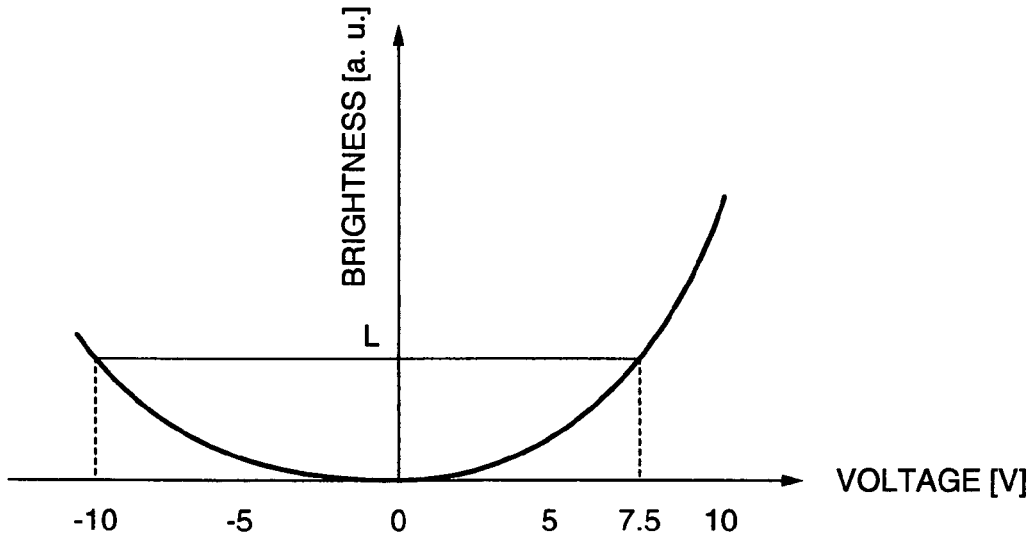
FIG. 7 is a drawing showing an example of the luminescence property of the light-emitting elements installed in the organic EL device 1 in the embodiment.

FIG. 7 is a drawing showing an example of the luminescence property of the light-emitting element installed in the organic EL device 1 in the embodiment. In a graph shown in FIG. 7, the horizontal axis indicates the voltage applied between the pixel electrode 23 and the common cathode 50 that are installed in the light-emitting element, and the vertical axis indicates the brightness of the light-emitting element. As shown in FIG. 7, when the forward-biased voltage is applied (refer to the positive area of the horizontal axis in FIG. 7), the brightness gradually increases as the voltage value increases. When the reverse-biased voltage is applied (refer to the negative area of the horizontal axis in FIG. 7), the brightness gradually increases as the absolute voltage value increases. The graph indicates that there is light emission during the application of both forward-biased and reverse-biased voltages.

However, the brightness obtained upon applying the forward-biased voltage and the reverse-biased voltage is, respectively, different. For instance, the brightness obtained when applying +5V of forward-biased voltage is lower than the brightness obtained when applying −5V of the reverse-biased voltage. This means that a periodical fluctuation of the brightness occurs when alternately applying the forward-biased voltage and the reverse-biased voltage with the same absolute values, resulting in flickering. In order to prevent this flickering, the power control circuit 10 in this embodiment alternately applies the forward-biased and reverse-biased voltages that have different voltage and polarity, to each of the power source lines 103R, 103G, and 103B.

Specifically, the value of the reverse-biased voltage is configured based on the forward-biased voltage, so that the difference (fluctuation) of the brightness between the one obtained upon application of the forward-biased voltage and the one obtained upon application of the reverse-biased voltage does not exceed a prescribed value. For instance, as shown in FIG. 7, if the brightness, obtained when applying +7.5V of forward-biased voltage, is L, then the value of the reverse-biased voltage is one that can obtain this brightness L. The value of the reverse-biased voltage is set to −10V in the example shown in FIG. 7.

It is desirable that the brightness obtained when applying the forward-biased voltage, and the brightness obtained when applying the reverse-biased voltage, be identical. If it is too problematic to make the two identical, then it is suitable to configure the reversed-biased voltage to fulfill the condition where ΔL is not greater than $L_{max}/D$: where ΔL is the difference between the brightness obtained when applying the forward-biased voltage and the brightness obtained when applying the reverse-biased voltage; $L_{max}$ is the maximum brightness of the light-emitting element when the forward-biased voltage is applied; and D is the number of gradations expressed by the light emission of the light-emitting element. The above-described number of gradation is, for instance, $2^6$=64 gradations, or $2^7$=128.

Figure 8A:
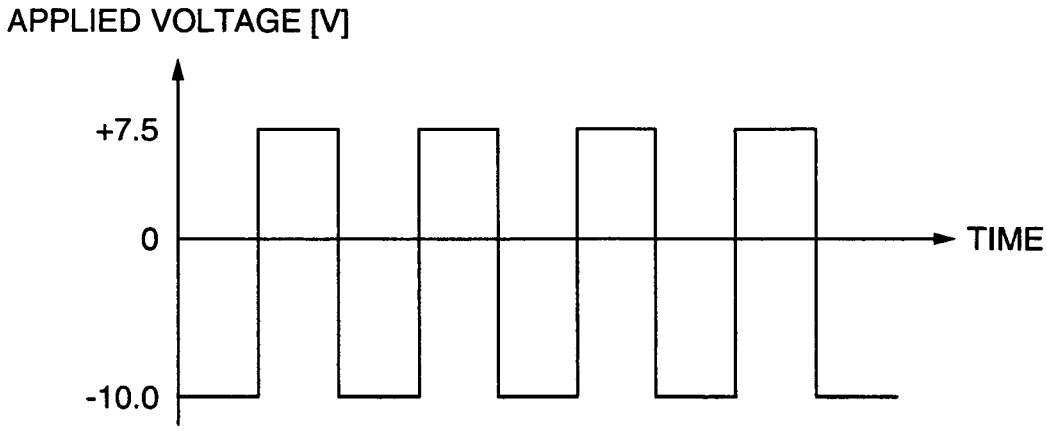
FIGS. 8A and 8B are drawings showing an example of a method for driving the organic EL device in the embodiment.
Figure 8B:
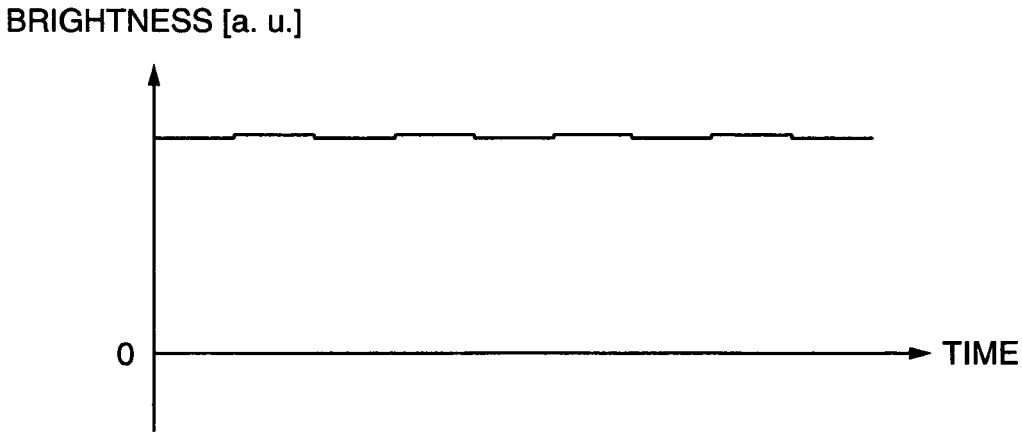

FIGS. 8A and 8B are drawings showing an example of a method for driving the organic EL device in the embodiment. As shown in FIG. 8A, the power control circuit 10 applies +7.5V of forward-biased voltage, and −10V of reverse-biased voltage. The forward and reverse biased voltages are supplied alternately to each of the pixel regions X through the power source lines 103R, 103G, and 103B. The timing with which the power control circuit 10 toggles between the forward and reverse biased voltages is determined, for example, by frame. Hence, if the organic EL device 1 shows 60 frames of images in one second, the toggling between the forward and reverse biased voltages is performed every one-sixtieth of a second. The toggling between the forward and reverse biased voltages may also be performed by several frames, and if one frame is made of several sub frames, it may also be performed by sub frames.

FIG. 8B is a drawing showing an example of the brightness of the light-emitting element, obtained when the forward and reverse biased voltages are applied alternately using a driving method in this embodiment. As shown in FIG. 8B, the brightnesses during the application of both forward-biased and reverse-biased voltages are approximately equal. In the example shown in FIG. 8B, the brightness during the application of the forward-biased voltage is slightly higher than that of the reverse-biased voltage. However, if the difference between them does not exceed the above-mentioned value ΔL, then it is not recognized visually as a flicker.

The organic EL device 1 in this embodiment includes three variations of emissive layers, i.e., the emissive layer 60R, the emissive layer 60G, and the emissive layer 60B, respectively corresponding to red, green, and blue. In the organic EL device 1, the emissive layers 60R, 60G, and 60B are provided, each in a quantity larger than one. As described above, each of the emissive layers is formed using different materials; hence the luminescence property thereof may be different. This means that even if the same forward-biased voltage is applied to each of the emissive layers 60R, 60G, and 60B, the brightness of each may be different. The same thing applies for the reverse-biased voltage. Therefore, it is desirable to configure the values of the forward and reverse biased voltages, per each of the emissive layers 60R, 60G, and 60B.

It is desirable that the toggling between the forward and reverse biased voltages applied to the emissive layers 60R be performed in the same pace. Similarly, this applies to the emissive layers 60G, and the emissive layers 60B. However, the toggling between the forward and reverse biased voltages for each emissive layer 60R, 60G, and 60B may be performed in a different pace, respectively.

Figure 9A:
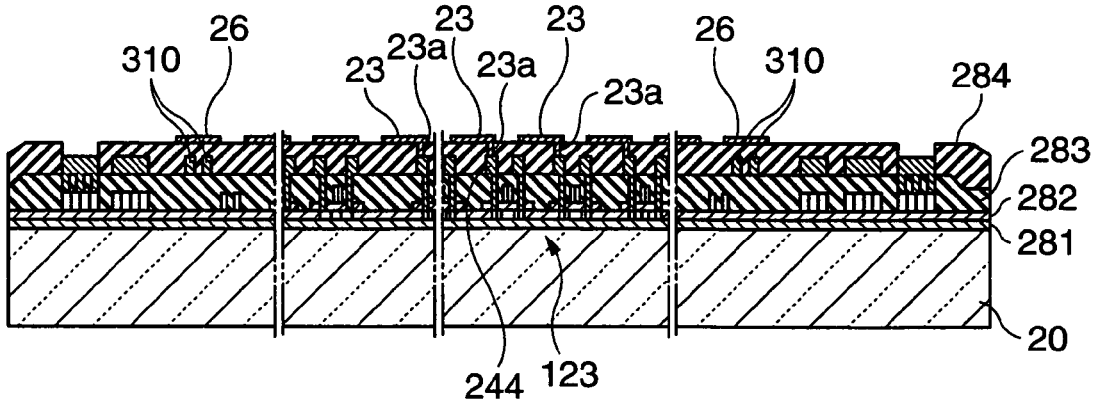
FIG. 9 is a sectional drawing showing a manufacturing process of the organic EL device 1 in accordance with one embodiment of the invention.
Figure 9B:
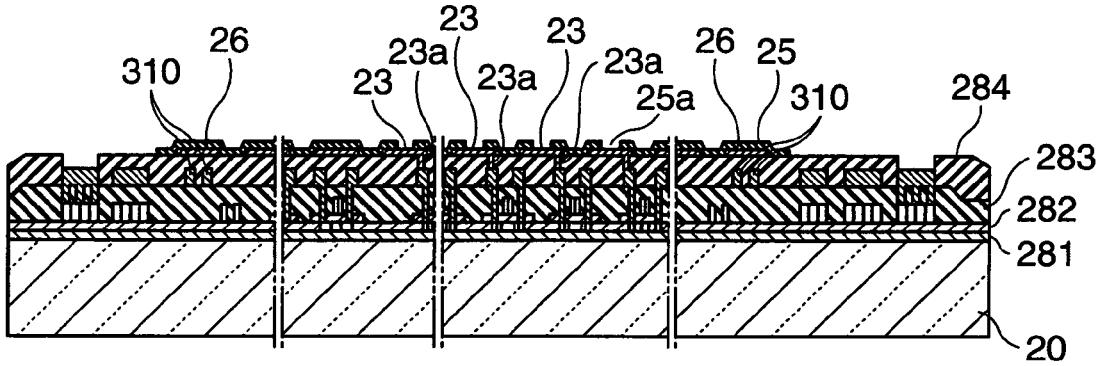
Figure 9C:
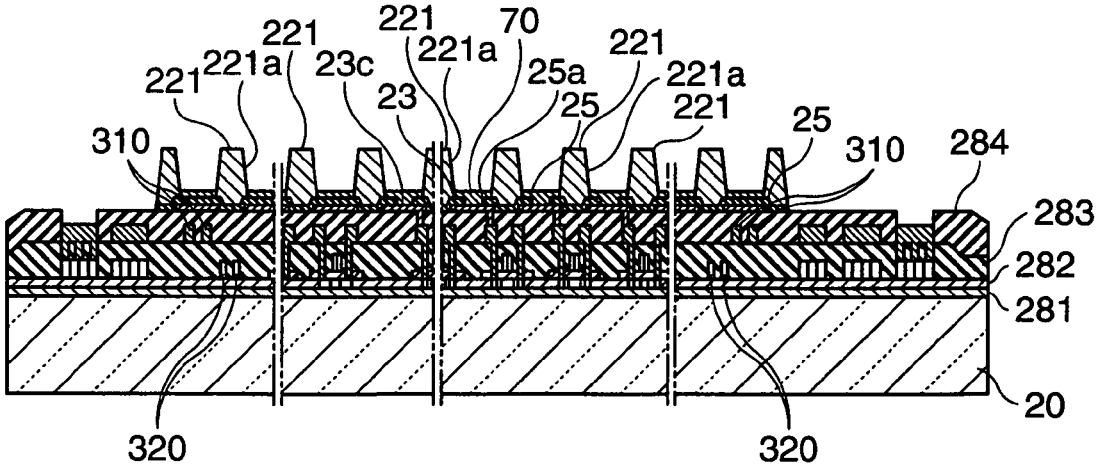
Figure 10A:
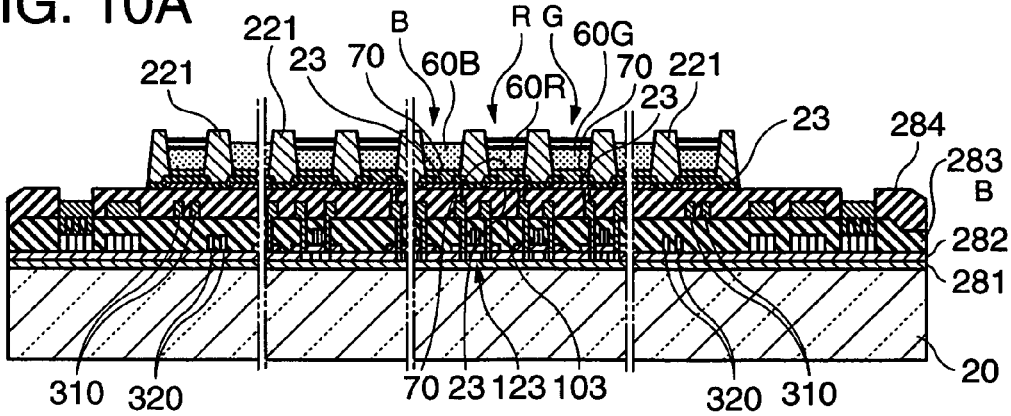
FIG. 10 is a sectional drawing showing the manufacturing process of the organic EL device 1 in accordance with one embodiment of the invention.
Figure 10B:
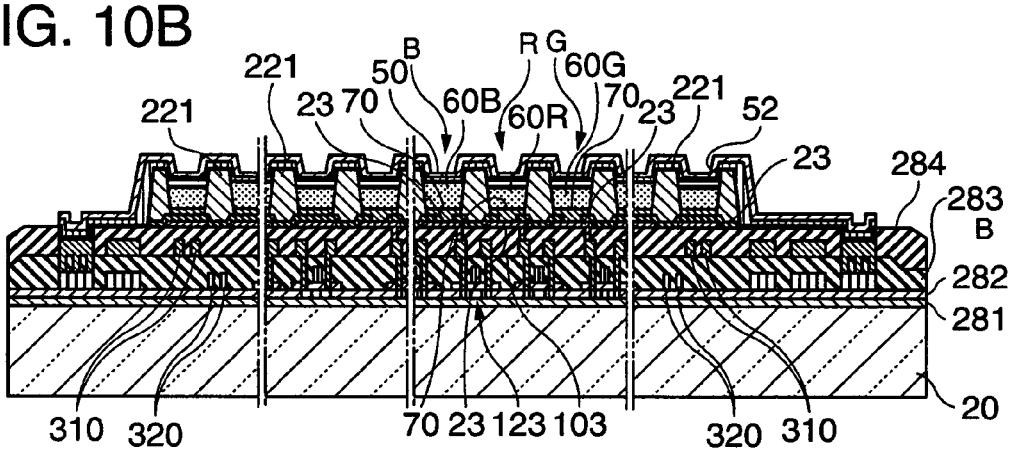
Figure 10C:
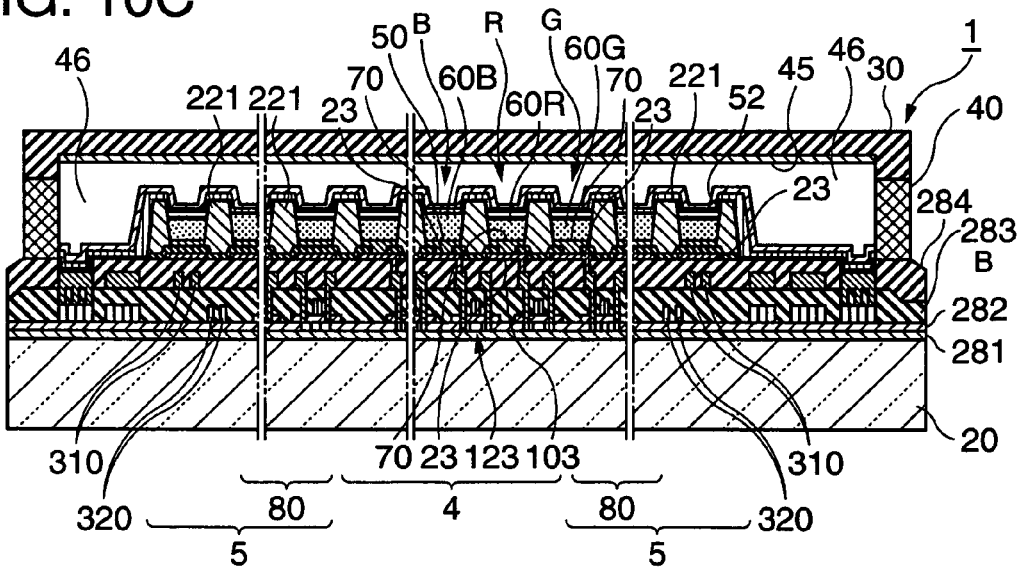

An example of a method for manufacturing the organic EL device 1 in this embodiment will now be described in brief. FIGS. 9 and 10 are sectional drawings showing manufacturing processes of the organic EL device 1 according to an embodiment of the invention. The sectional drawings shown in FIGS. 9A to 9C and 10A to 10C correspond to the cross section A to B in FIG. 2, aligned sequentially in the same order as the manufacturing process. First, as shown in FIG. 9A, the pixel electrodes 23 are formed on the surface of the circuit unit 11 on the substrate 20. More specifically, a conductive film, composed with a conductive material such as ITO, is formed so as to cover the entire surface of the substrate 20. Here, contacts are formed by filling the conductive material into contact holes 23*a* in the second interlayer insulation layer 284. Thereafter, the pixel electrodes 23 are formed by patterning this conductive film, and are electrically continued to the drain electrodes 244 of the driving TFTs 123 via the contacts. At the same time, dummy patterns 26 in the dummy region are formed.

The pixel electrodes 23 and the dummy patterns 26 are together collectively called the pixel electrodes 23 in FIGS. 3 and 4. The dummy patterns 26 are formed in an island-shape, in a similar way to the pixel electrodes 23 formed in the effective display region. However, they are not connected to the metal wiring in a layer below via the second interlayer insulation layer 284. The shape of the pattern of the dummy patterns 26 may be different from that of the pixel electrodes 23 formed on the display region. In this case, the dummy patterns 26 include the ones located above the driving voltage continuity parts 310 (340).

Thereafter, as shown in FIG. 9B, the lyophilic control layer 25 is formed on the pixel electrodes 23, the dummy patterns 26, and on the second interlayer insulation layer 284. The lyophilic control layer 25 is formed to have openings on part of the pixel electrodes 23, so as to have hole mobility from the pixel electrodes in the openings 25*a* (refer to FIG. 3). Subsequently, the BM (not shown) is formed on the convex parts that are located in-between the pixel electrodes 23 in the lyophilic control layer 25. The BM is deposited on the convex parts of the lyophilic control layer 25 by the sputtering, using chromium.

Thereafter, as shown in FIG. 9C, the organic bank layer 221 is formed on the prescribed location of the lyophilic control layer 25, so as to cover the BM. An example of a method for forming the organic bank layer 221 include forming the organic layer by coating the layer below with a material in which the resist, such as acrylic resin or polyimide resin, is dissolved into a solvent, using various coating methods such as spin coating or dip coating. The material constituting the organic layer may be anything that does not dissolve into a solvent of an ink (described later), and which is easy to pattern with etching or the like. Subsequently, the patterning is performed on the organic layer using a photolithography and etching techniques, so as to form the openings 221*a* for the bank, in the organic layer, thereby forming the organic bank layer 221 that has walls in the openings 221*a*. In this case, the organic bank layer 221 includes the part located above the driving control signal continuity parts 320.

Thereafter, a region with lyophilic property and a region with liquid-repellent property are formed on the surface of the organic bank layer 221. In this embodiment, each region is formed with a plasma processing. The plasma processing includes: preheating; a process for making the top surface of the organic bank layer 221, the wall surface of the openings 221*a*, electrode surfaces 23*c* of the pixel electrodes 23, and the top surface of the lyophilic control layer 25, ink-philic (lyophilic); a process for making the top surface of the organic bank layer 221 and the wall surface of the openings 221*a* ink-repellent (liquid-repellent); and cooling.

Specifically, a plasma processing ($O_2$ plasma processing), in which the base material (the substrate 20 including the banks, etc.) is heated to approximately within the range of 70 to 80 degrees Celsius inclusive, after which, as a part of the ink-philic process, making oxygen a reactive gas under the atmospheric pressure, is conducted. Subsequently, another plasma processing ($CF_4$ plasma processing), in which tetrafluoromethane is used as the reactive gas under the atmospheric pressure as a part of the ink-repellent process, is conducted. Thereafter, the base material heated for the plasma processing is cooled down to the room temperature. Consequently, the lyophilic and liquid-repellent properties are provided to the prescribed locations.

In the $CF_4$ plasma processing, there is a slight effect on the electrode surfaces 23*c* of the pixel electrodes 23, and on the lyophilic control layer 25. However, there is a poor lyophilic property in ITO which is the material for pixel electrodes 23, and in the material constituting the lyophilic control layer 25, such as $SiO_2$ and $TiO_2$. Therefore, a hydroxyl group provided during the ink-philic process is not substituted with a fluorine group, and the lyophilic property is maintained.

Thereafter, the anode buffer layer 70 is formed in an anode buffer layer forming process. In this anode buffer layer forming process, an inkjet method, particularly, is suitably employed as a liquid discharge method. In other words, with this inkjet method, an anode buffer layer forming material is selectively arranged and coated on the electrode surfaces 23*c*. Subsequently, drying and heating treatment is conducted, and the anode buffer layer 70 is formed on the pixel electrodes 23. The material used for forming the anode buffer layer 70 is, as described above, a material in which the PEDOT/PSS is dissolved into the polar solvent, such as water or isopropyl alcohol.

The process of forming the anode buffer layer 70 by this inkjet method includes: filling the anode buffer layer forming material into the inkjet head (figure abbreviated); and placing the nozzle of the inkjet head so that it faces the electrode surfaces 23*c* that are located inside the openings 25*a* formed in the lyophilic control layer 25, while shifting the inkjet head relative to the substrate (the substrate 20). Thereafter, droplets, in which the quantity of one drop is controlled, are discharged from the discharge nozzle to the electrode surfaces 23*c*. Subsequently, the anode buffer layer 70 is formed by drying the droplets after the discharge, and by evaporating the dispersion medium and the solvent contained in the anode buffer layer forming material.

Here, the droplet discharged from the discharge nozzle spreads on the electrode surfaces 23*c* on which the lyophilic processing is performed, and is filled inside the openings 25*a* of the lyophilic control layer 25. On the other hand, on the surface of the organic bank layer 221, on which the ink-repellent process is performed, the liquid is repelled and does not adhere. Consequently, even if the droplet is misaligned from the prescribed discharge position and the part of the droplet covers the surface of the organic bank layer 221, the surface does not get wet from the droplet, and the repelled droplet is pulled into the openings 25*a* of the lyophilic control layer 25.

The firing temperature is desirably set to a range of 100 to 200 degrees Celsius inclusive, where approximately 120 degrees Celsius, in particular, is a preferable value. If the temperature is less than 100 degrees, then the material may not be hardened sufficiently, and if the material for the emissive layer is provided thereon, then the two materials may be mixed, or the solvent contained may not be completely removed. On the other hand, if the temperature exceeds 200 degrees, then the material may deteriorate and be altered by the heat. It is suitable to use an inert gas such as nitrogen and argon, after this anode buffer layer forming process, in order to prevent oxidation and moisture absorption of the various forming materials and the formed elements.

Thereafter, as shown in FIG. 10A, the emissive layers 60 are formed in an emissive layer forming process. In this emissive layer forming process, similar to the process of the anode buffer layer 70 formation, the inkjet method is suitably employed as the liquid discharge method. The emissive layers 60 are formed inside the openings 221*a* formed in the organic bank layer 221, by discharging an emissive layer forming material on the anode buffer layer 70 with the inkjet method, and thereafter by conducting the drying and heating treatments. The emissive layers 60 are formed per color. The inkjet method (droplet discharge method) allows a selective arrangement of the material for the emissive layers 60, so as to arrange it to the prescribed locations (only to the pixel regions). It also allows a change of a discharge quantity per location. Moreover, in this emissive layer forming process, a nonpolar solvent, in which the anode buffer layer 70 does not dissolve, is used as the solvent for the emissive layer forming material, in order to prevent the dissolution thereof.

Thereafter, as shown in FIG. 10B, the cathode buffer layer 52 is formed. In this process, the cathode buffer layer 52 is formed so as to cover the emissive layers 60 and the organic bank layer 221, by coating a liquid substance that contains the constituent material of the cathode buffer layer 52. If previously-mentioned PEDOT/PSS is employed as the material for the cathode buffer layer 52, then 3,4-polyethylene-dioxythiophene is dispersed into the dispersion medium of polystyrenesulfonate, and this is thereafter dissolved into a polar solvent, such as water or isopropyl alcohol.

By employing the polar solvent as the dispersion medium or the solvent as described above, the dissolution of the emissive layers 60 in the liquid substance coated thereon may be suppressed. If there is an exceptional elution of the emissive layers 60 into the polar substance, a nonpolar substance such as toluene, xylene, benzene, hexane, cyclohexane, tetradecane, and isooctane, may be used as the dispersion medium or the solvent.

Subsequently, the liquid substance formed above is coated on the surface of the emissive layers 60 and the organic bank layer 221. The inkjet method, as well as the spin coating method, may also be employed for coating, as in the case of forming the emissive layers 60 or the anode buffer layer 70. Thereafter, the cathode buffer layer 52 is formed by drying and firing the coated liquid substance. It is desirable to set the deposition temperature of the cathode buffer layer 52 to be not more than 150 degrees Celsius. If the temperature exceeds 150 degrees, then the functionality of the emissive layers 60 composed with the organic matter may deteriorate. If the PEDOT/PSS is employed as the conductive material, the firing may be performed with a condition of 100 degrees temperature for a duration of 10 minutes, allowing the suppression of the damage to the emissive layers 60.

Thereafter, the common cathode 50 is formed. There is no specific limitation on the material of the common cathode 50, as long as it is a conductive air-stable material, except that a material that has a small work function with the anode is desirable. If ITO is used for the anode, aurum (Au) may be used. Subsequently, as shown in FIG. 10C, the surface of the substrate 20 is sealed with the sealing substrate 30. In this sealing process, the sealing substrate 30, on which the getter material 45 is pasted to the internal surface thereof, is adhered to the substrate 20 with the sealing resin 40. This sealing process is suitably performed inside an inert gas atmosphere, such as nitrogen, argon, and helium. The inert gas is sealed in an airtight manner in the space surrounded by the substrate 20, the sealing substrate 30 and the sealing resin 40. Finally, the formation of the organic EL device 1 in this embodiment is completed.

As described in detail above, the anode buffer layer 70 and the cathode buffer layer 52 are composed with the conductive polymer, in the organic EL device 1 and the manufacturing method thereof in this embodiment. With this structure, there is a continuous light emission during the application of both forward-biased and reverse-biased voltages that have different polarities. Therefore, the accumulation of the charges and of the impurity ions inside the light-emitting element, as well as the internal electric field generated by the impurity ions, are moderated, thereby allowing a display without shortening the effective light emission time. The forward-biased and reverse-biased voltages that have different voltage values and polarities are alternately applied. Therefore, even if the luminescence property of the light-emitting element is different when compared between the cases when the forward-biased voltage is applied and when the reverse-biased voltage is applied, then flickering is prevented.

Figure 11A:
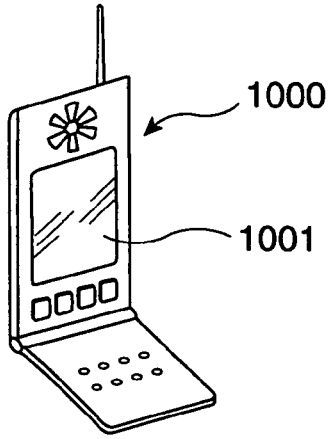
FIGS. 11A to 11C are drawings showing examples of electronic appliances in accordance with one the embodiment of the invention.
Figure 11B:
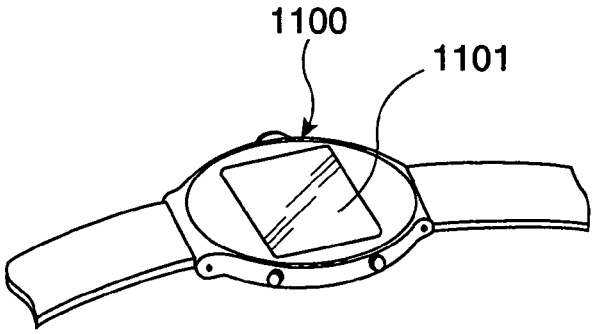
Figure 11C:
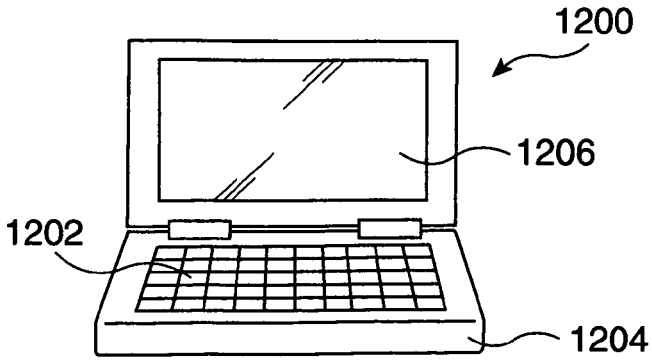

The electronic appliance according to the embodiment of the present invention will now be described. This electronic appliance includes the above-mentioned organic EL device 1 (EL display device 1) as a display unit. Examples of this appliance are indicated in FIGS. 11A to 11C. FIGS. 11A to 11C are drawings showing the examples of the electronic appliance according to the embodiment of the invention. FIG. 11A is an oblique drawing showing an example of a mobile phone. A mobile phone 1000 in FIG. 11A is provided with a display unit 1001 that utilizes the above-mentioned EL display device 1. FIG. 11B is an oblique drawing showing an example of an electronic appliance with the shape of a wristwatch. A wristwatch 1100 in FIG. 11B is provided with a display unit 1101 that utilizes the above-mentioned EL display device 1. FIG. 11C is an oblique drawing showing an example of a mobile information-processing device such as a word processor and personal computer. An information-processing device 1200 in FIG. 11C is provided with an input unit 1201, a display unit 1202 that utilizes the above-mentioned EL display device 1, and a body (a case) of the information-processing device 1203. The display units 1001, 1101, and 1202, in these electronic appliances, shown in FIGS. 11A to 11C, provide a long lifetime to their light-emitting elements, due to the effect described above.

What is claimed is:

1. An organic electroluminescence device comprising:

an emissive layer between an anode and a cathode facing each other;

an anode buffer layer formed of a conductive material, installed between the anode and the emissive layer;

a cathode buffer layer formed of the conductive material, installed between the cathode and the emissive layer; and a driving device which alternately applies a forward-biased voltage and a reverse-biased voltage which have different voltage values and polarities, to the anode and the cathode, wherein the forward-biased voltage value and the reverse-biased voltage value are configured so that a fluctuation of a brightness of the emissive layer does not exceed a prescribed value.

2. The organic electroluminescence device according to claim 1, wherein one of the forward-biased voltage value and the reverse-biased voltage value is configured based on the other.

3. An electronic appliance comprising the organic electroluminescence device according to claim 1.

4. The organic electroluminescence device according to claim 1, wherein the prescribed value is configured not to exceed the brightness obtained by dividing the maximum brightness of the emissive layer by the number of gradations expressed by a light emission of the emissive layer.

5. The organic electroluminescence device according to claim 1, wherein:

the emissive layer includes a red emissive layer that emits red light, a green emissive layer that emits green light, and a blue emissive layer that emits blue light; and the driving device changes the values of the forward-biased voltage and the reverse-biased voltage applied, for the red emissive layer, for the green emissive layer, and for the blue emissive layer.

6. The organic electroluminescence device according to claim 1, wherein the driving device alternately applies the forward-biased voltage and the reverse-biased voltage, by a frame unit or a sub frame unit of a display image displayed in the organic electroluminescence device, the sub frame being provided by a time division of one frame divided into several parts.

7. The organic electroluminescence device according to claim 1, wherein the anode buffer layer and the cathode buffer layer are formed of a conductive polymer.

8. The organic electroluminescence device according to claim 1, wherein the anode buffer layer and the cathode buffer layer are formed of a high polymer which includes ethylenedioxythiophene.

9. The organic electroluminescence device according to claim 1, wherein the anode buffer layer and the cathode buffer layer are formed of polyethylene(3,4-dioxythiophene) /polystyrene sulfonate.

10. The organic electroluminescence device according to claim 1, wherein sheet resistivities of the anode buffer layer and the cathode buffer layer are less than 100Ω cm.

11. A method for driving an organic electroluminescence device, comprising applying alternately one forward-biased voltage and a reverse-biased voltage which have different voltage values and polarities to an anode and a cathode, wherein:

at least an emissive layer is provided between the anode and the cathode which face each other; an anode buffer layer formed of a conductive material is installed between the anode and the emissive layer; and a cathode buffer layer formed of the conductive material is installed between the cathode and the emissive layer, wherein the values of the forward-biased voltage and the reverse-biased voltage are configured so that a fluctuation of brightness of the emissive layer does not exceed a prescribed value.

12. The method for driving the organic electroluminescence device, according claim 11, wherein one of the forward-biased voltage value and the reverse-biased voltage value is configured based on the other.

13. The method for driving the organic electroluminescence device, according to claim 11, wherein the forward-biased voltage and the reverse-biased voltage are alternately applied, by a frame unit or a sub frame unit of a display image displayed in the organic electroluminescence device, the sub frame being provided by a time division of one frame divided into several parts.

14. The method for driving the organic electroluminescence device, according to claim 11, wherein the prescribed value is configured not to exceed the brightness obtained by dividing the maximum brightness of the emissive layer by the number of gradations expressed by a light emission of the emissive layer.

15. The method for driving the organic electroluminescence device, according to claim 11, wherein:

the emissive layer includes a red emissive layer that emits red light, a green emissive layer that emits green light, and a blue emissive layer that emits blue light; and the forward-biased voltage and the reverse-biased voltage which have different voltage values and polarities are alternately applied, for the red emissive layer, for the green emissive layer, and for the blue emissive layer.

* * * * *